US011737586B1

(12) United States Patent
Welker et al.

(10) Patent No.: US 11,737,586 B1
(45) Date of Patent: Aug. 29, 2023

(54) MERCHANDISE DISPLAY STAND

(71) Applicant: ImageWorks Display and Marketing Group, Inc., Winston-Salem, NC (US)

(72) Inventors: Brian Hart Welker, Summerfield, NC (US); David Scott Ireland, Winston-Salem, NC (US)

(73) Assignee: ImageWorks Display and Marketing Group, Inc., Winston-Salem, NC (US)

( * ) Notice: Subject to any disclaimer, the term of this patent is extended or adjusted under 35 U.S.C. 154(b) by 0 days.

(21) Appl. No.: 17/591,876

(22) Filed: Feb. 3, 2022

(51) Int. Cl.
*A47F 5/08* (2006.01)
*A47B 96/14* (2006.01)

(52) U.S. Cl.
CPC ..... *A47F 5/0823* (2013.01); *A47B 96/1458* (2013.01); *A47B 96/1466* (2013.01)

(58) Field of Classification Search
CPC ..... A47F 5/0823; A47B 96/145; A47B 96/14; A47B 96/1408; A47B 96/1416; A47B 96/1433; A47B 96/1466; A47B 96/1475; A47B 96/1483; A47B 2096/1491; A47B 96/148; A47B 96/1458
USPC ..... 211/103, 187, 190, 207
See application file for complete search history.

(56) References Cited

U.S. PATENT DOCUMENTS 2,252,997 A * 8/1941 Vanderveld ..... A47B 96/1458 248/243
2,355,651 A * 8/1944 Hormes ..... A47B 96/1458 248/222.51
3,209,709 A * 10/1965 Shoffner ..... A47F 5/103 108/157.13
3,782,048 A * 1/1974 Corman ..... A47B 96/1475 D25/120
3,826,207 A * 7/1974 Sutherlan ..... A47B 57/485 211/90.01
3,958,695 A * 5/1976 Allsop ..... A47F 7/08 211/37
4,065,904 A * 1/1978 Taylor ..... E04B 2/7854 248/245
4,189,459 A * 2/1980 Jones ..... B29C 70/84 264/269
4,192,424 A * 3/1980 Allsop ..... A47F 7/08 248/297.21
4,753,354 A * 6/1988 Patterson ..... A47B 57/54 211/207

(Continued)

OTHER PUBLICATIONS

Lighting for Impact, Product Catalog 2022 "LED Retail Merchandising Solutions. Transform the way your customers see, shop and spend.", 24 pages.

*Primary Examiner* — Jennifer E. Novosad
(74) *Attorney, Agent, or Firm* — NK Patent Law

(57) ABSTRACT

A merchandise display stand includes a pair of brackets for carrying a panel having advertising indicia on a first end thereof. A plurality of spaced-apart upright supports extend vertically, and a channel extends across a horizontal support that spans the spaced-apart upright supports. The channel defines an upper and lower flange. The upper and lower flange define a space therebetween for selectively receiving a power cord. Each bracket defines a pair of shoulders on a second end thereof. Each of the shoulders is configured for engaging with a respective flange to receivably engage each of the brackets with the channel.

12 Claims, 8 Drawing Sheets

(56) References Cited

U.S. PATENT DOCUMENTS 4,886,235 A * 12/1989 Thornborrow ..... E01F 9/623 248/224.8
5,255,803 A * 10/1993 Pavone ..... A47F 5/00 248/220.21
5,271,204 A * 12/1993 Wolf ..... G09F 15/0068 52/844
5,425,648 A * 6/1995 Farham ..... H01R 25/16 439/116
5,517,795 A * 5/1996 Doke ..... E04F 13/081 248/243
5,695,261 A * 12/1997 Slesinger ..... A47F 11/10 439/116
6,047,838 A * 4/2000 Rindoks ..... A47B 96/1458 211/187
6,164,467 A * 12/2000 DePottey ..... A47F 5/0846 52/36.5
6,527,565 B1 * 3/2003 Johns ..... H01R 25/142 362/418
7,165,690 B2 * 1/2007 Wu ..... A47B 96/145 211/187
8,186,281 B2 * 5/2012 Bastian ..... A47B 83/001 108/50.02
8,752,718 B2 * 6/2014 Stukenberg ..... A47F 7/24 211/87.01
8,967,740 B2 * 3/2015 Kerner ..... H01R 43/00 439/110
9,307,669 B1 * 4/2016 Briggs ..... A47B 81/064
9,366,470 B2 * 6/2016 Hastürk ..... F25D 25/02
9,537,274 B1 * 1/2017 Dankelmann ..... A47F 5/0043
9,596,948 B1 * 3/2017 McGinnis ..... A47F 5/103
9,782,018 B2 * 10/2017 Hester-Redmond ..... A47F 5/08
9,831,642 B2 * 11/2017 Woodley ..... H02B 1/04
9,961,795 B2 * 5/2018 Chen ..... H05K 7/1422
10,646,058 B2 * 5/2020 Jones ..... A47F 11/10
11,122,897 B2 * 9/2021 Decker ..... A47B 96/1458
2005/0254262 A1 * 11/2005 Chiu ..... H01R 25/162 362/648
2006/0207778 A1 * 9/2006 Walter ..... A47B 96/1475 174/19
2008/0000861 A1 * 1/2008 Muellerleile ..... A47B 96/06 211/94.01
2008/0043456 A1 * 2/2008 Bernardini ..... F25D 25/02 362/125
2011/0215212 A1 * 9/2011 Keyvanloo ..... A47B 96/1466 248/220.22
2014/0224875 A1 * 8/2014 Slesinger ..... A47F 5/0043 439/38
2015/0201762 A1 * 7/2015 Walter ..... A47F 5/0853 211/187
2015/0333490 A1 * 11/2015 Wessel ..... H02B 1/20 361/622

* cited by examiner

10

28
60
62

28
58
56

56

MERCHANDISE DISPLAY STAND

BACKGROUND

Field of the Invention

The present invention relates to a merchandise display stand, and, more particularly, towards a merchandise display stand configured for having improved structural performance and ease of use.

Description of Related Art

Merchandise display stands are used for displaying merchandise. There are several varieties available, each providing various purposes and intents, each also having various advantages and disadvantages.

One commonality among most merchandise display stands is the ability to configure the shelves and spacing thereof in order to accommodate merchandise of various size and configuration, as well as to fit within available spacing in a retail establishment, as an example. The stands must be highly adaptable in order to accommodate these various considerations.

One problem with conventional merchandise display stands is that the shelving often uses conventional hook style fasteners that insert into corresponding recesses formed in an upright support bracket for the display stand. However, the brackets are of differing sizes, shapes, thickness, and the like as each manufacturer may have employed different dimensionality in designing brackets, and the brackets are oftentimes not compatible with a given support. In these instances, the bracket either does not fit at all, or fits but does so loosely and is subject to failure once a load has been placed onto the shelving.

BRIEF SUMMARY

According to one embodiment of the present invention, a merchandise display stand includes a vertically extending support configured for being positioned about a ground surface or against a vertical wall. The vertically extending support defines a plurality of channels extending vertically along a length of the vertically extending support. The channels are configured for engaging one or more accessories. A panel/main support board is configured for extending from the vertically extending support and configured for serving as origination point for brackets, hooks, or other merchandise display accessories. The panel may be any appropriately configured board for engaging with merchandise display accessories.

A bracket retention support is configured for being positioned within a front-facing one of the plurality of channels. The bracket retention support defines spaced-apart openings for receiving hooks or shoulders of a bracket. The brackets are configured for supporting the shelf or display. Another bracket retention support of a different thickness or spacing between the spaced-apart openings is configured for selectively replacing the bracket retention support depending on a desired user configuration.

According to one or more embodiments, the bracket retention support defines a u-shaped configuration and a base of the u-shaped configuration defines the spaced-apart openings.

According to one or more embodiments, the bracket retention support is slideably received within the front-facing one of the plurality of channels.

According to one or more embodiments, the front-facing one of the plurality of channels defines a cut-out along a length thereof for providing access to the plurality of spaced-apart openings.

According to one or more embodiments, the panel defines a shoulder that is received within a side-facing one of the plurality of channels.

According to one or more embodiments, the panel is one of a peg board, slat board, solid board, wire grid, and the like.

According to one or more embodiments, wherein the stand includes an electrical power source that is configured for providing power to a lead running along a length of a channel of the plurality of channels that the electrical power source is engaged with.

According to one or more embodiments, the electrical power source includes an I/O port that receives a cable that provides power.

According to one or more embodiments, wherein the display stand includes an insert for being received within a channel of the plurality of channels, the insert defining graduation lines or other visual indicators for displaying position along the channel.

According to one or more embodiments, the display stand includes support braces extending from the support.

DETAILED DESCRIPTION

Figure 1A:
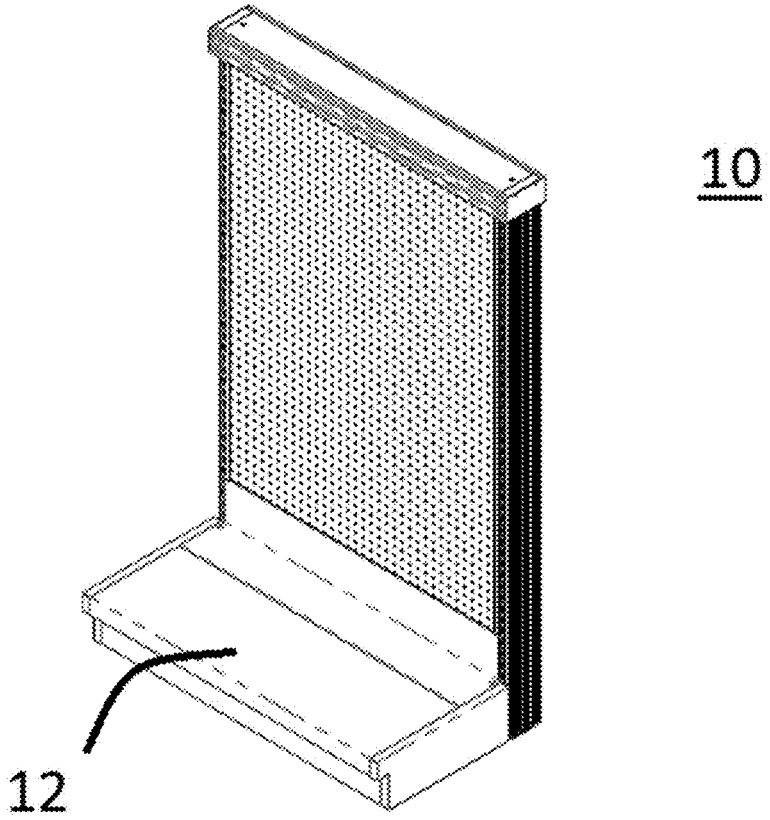
FIG. 1A illustrates a perspective display stand assembly according to one or more embodiments disclosed herein.
Figure 1B:
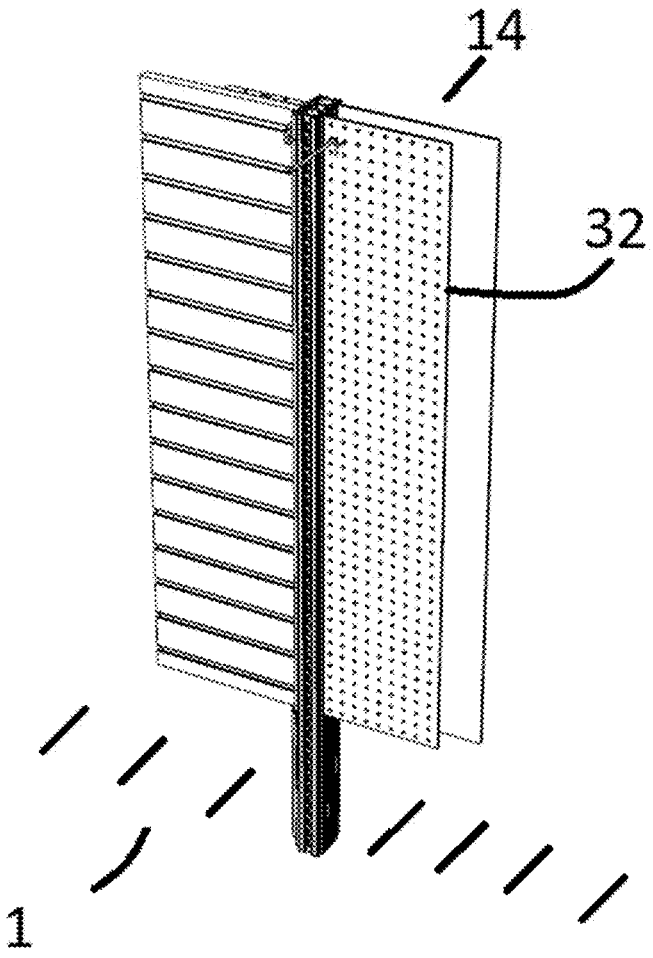
FIG. 1B illustrates a partial, perspective display stand assembly according to one or more embodiments disclosed herein.
Figure 2:
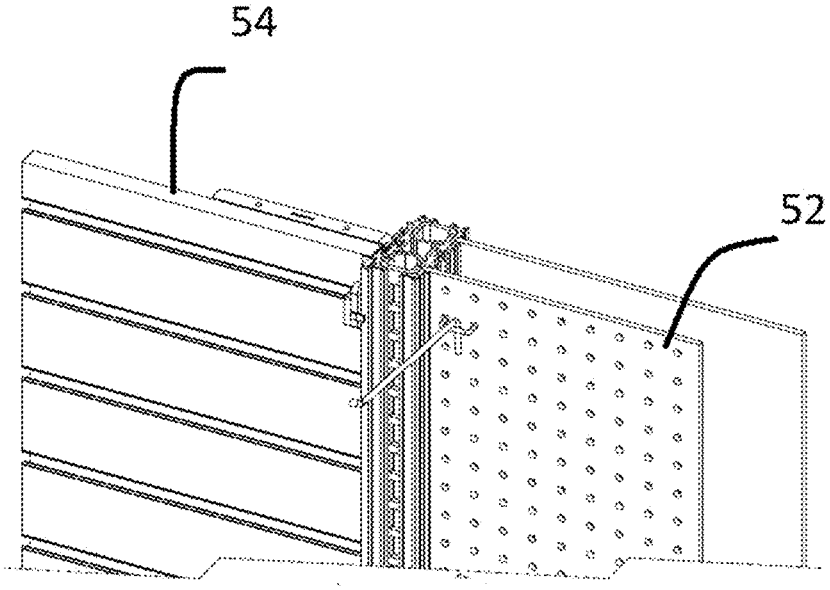
FIG. 2 illustrates a top facing, perspective view of a display stand assembly according to one or more embodiments disclosed herein.

A merchandise display stand is illustrated throughout the drawings and is generally designated 10. The merchandise display stand 10 is illustrated in FIGS. 1A and 1B and may be used in any appropriate setting or circumstance, including in a retail setting such as for displaying merchandise for selection and purchase by a consumer. The merchandise display stand 10 may be positioned proximal a wall or other structure for being secured in place. Any suitable fastener may be employed for securing the merchandise display stand 10 to the wall. Various components associated with this particular display stand are also illustrated.

The merchandise display stand 10 may include a vertically extending support 12 configured for being positioned about a ground surface 1 or against a vertical wall. The vertically extending support 12 defines a plurality of channels (collectively, 14, individually called out with further detail herein). The plurality of channels 14 extend vertically along a length of the vertically extending support 12. The channels 14 are configured for engaging one or more accessories that will be described further herein.

Figure 6:
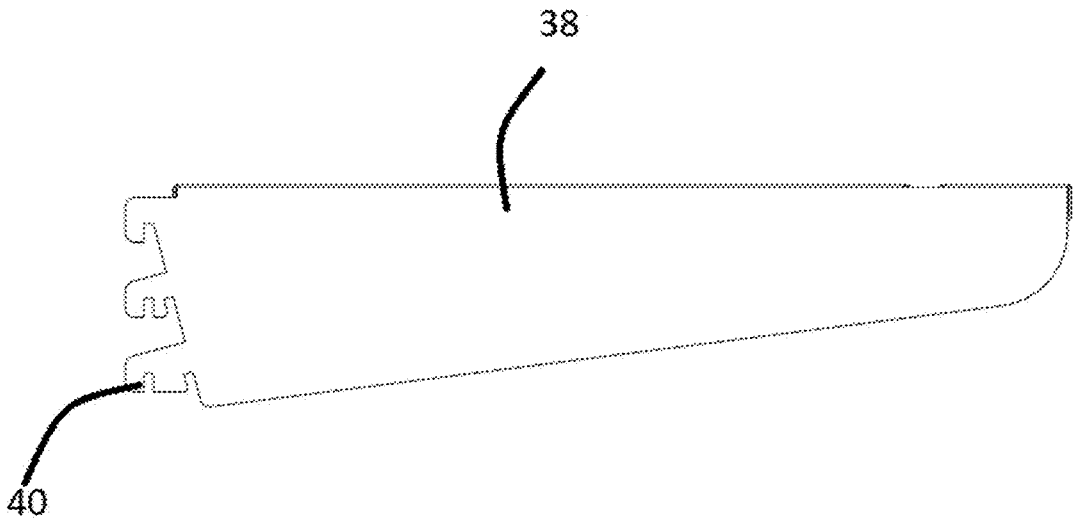
FIG. 6 illustrates a bracket for use with the display stand assembly according to one or more embodiments disclosed herein.

A panel 32 is configured for extending from the vertically extending support 12 and configured for serving as a display or for having shelves, hooks, or other retail accessories extending or originating therefrom. The panel 32 may be a peg board 52 or slatwall 54, or any other appropriate configured panel. The panel 32 extends a length between adjacent vertically extending supports 12, and the vertically extending supports 12 accommodate one or more brackets (see bracket 38 in FIG. 6 with shoulders 40) that hold a shelf, a lighted display, or similar. Alternatively, the peg board 52 assembly may be employed and retail items hang from the pegs in a conventional manner.

Brackets 38 are configured for being received within a bracket retention support 34. The bracket retention support 34 is configured for being positioned within a front-facing one of the plurality of channels. The bracket retention support 34 is illustrated having a certain thickness and certain spacing between openings 36.

In practice, the spacing between adjacent shoulders/hooks 40 between different manufacturing brackets is different. Additionally, the thickness from which the shoulders/hooks 40 extend from the main body of the bracket 38 is often different. Because of these differences, the brackets 38 either don't fit, or don't fit well and present structural integrity issues where a shelf could fall or otherwise fail because of improper fit of the bracket 38.

Figure 3A:
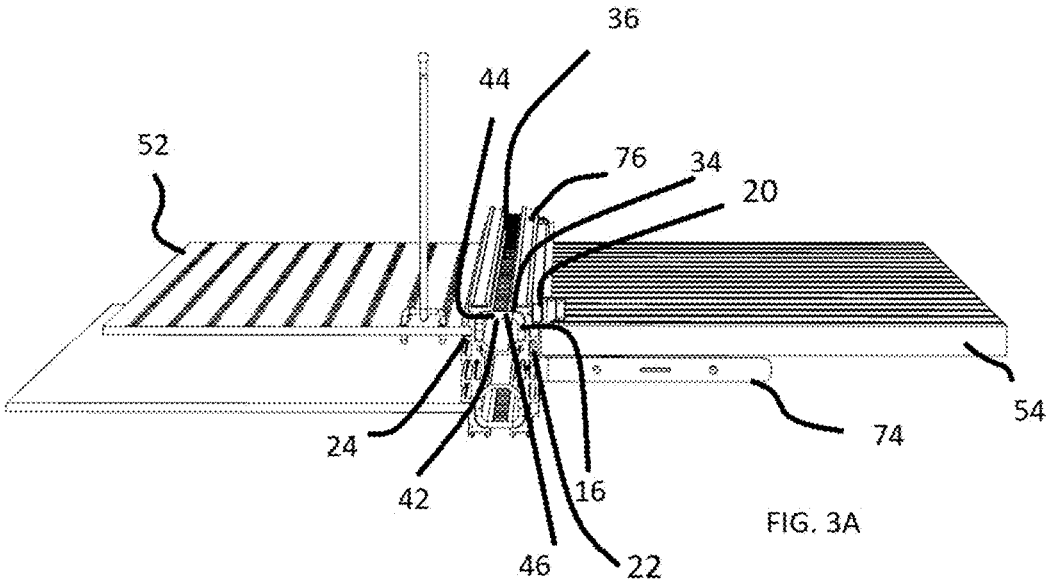
FIG. 3A illustrates a top facing, perspective view of a display stand assembly according to one or more embodiments disclosed herein.
Figure 3B:
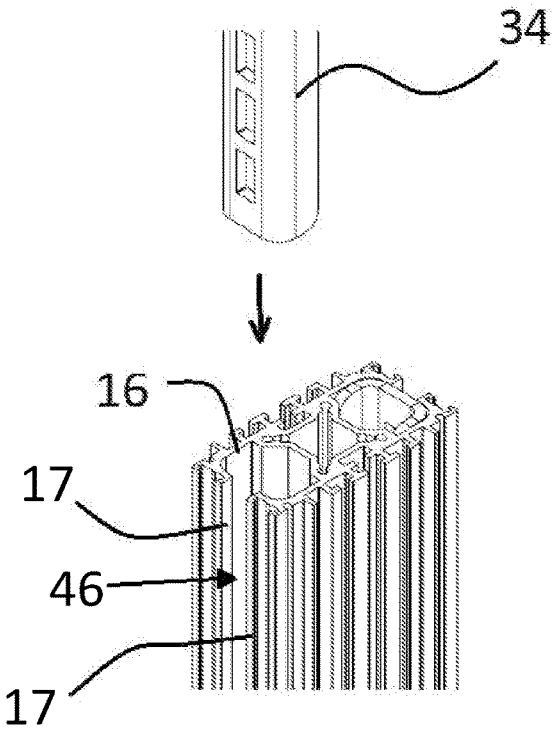
FIG. 3B illustrates a perspective view of a bracket retention support being slideably received within a channel according to one or more embodiments disclosed herein.
Figure 3D:
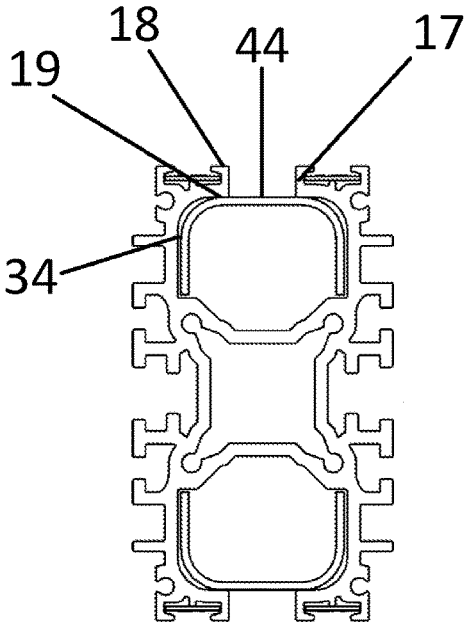
FIG. 3D illustrates a top view of a vertically extending support having bracket retention supports within channels according to one or more embodiments disclosed herein.
Figure 3C:
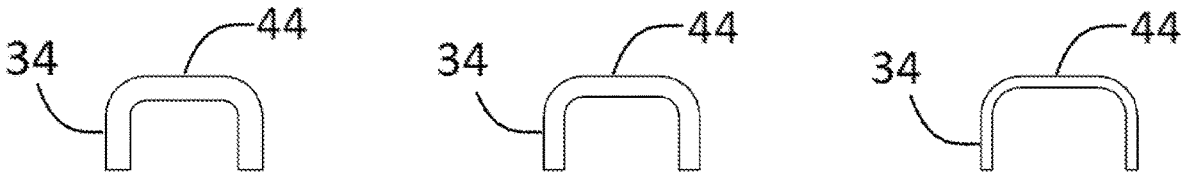
FIG. 3C illustrates a bottom view of a series of bracket retention supports having bases of different thicknesses according to one or more embodiments disclosed herein.

The bracket retention support 34 is thus replaceable with another bracket retention support 34 that has a different thickness for its base 44, as shown in FIG. 3C, or spacing between the spaced-apart openings. In this manner, if the bracket 38 is configured for a different size than the current bracket retention support 34, an appropriately sized bracket retention support 34 can then replace the prior version. The bracket retention supports 34 may be slideably replaced as illustrated, where an operator can slide one bracket retention support 34 out for another. The bracket retention support 34 is shown within the front-facing channel indicated by 16, in FIG. 3A. A cutout 46 is illustrated in FIGS. 3A and 3B in the front-facing channel 16 between two shoulder portions 17, as shown in FIG. 3B, to allow pass-through of the shoulders/hooks 40 of the bracket 38. As visible in FIG. 3D, each shoulder portion 17 has a first surface 18 and opposed second surface 19, the first surface 18 being a part of the periphery of the vertically extending support 16 and the second surface 19 abutting the base 44 of the bracket retention support 34 when the bracket retention support 34 is inserted into one of channels, such as the front-facing channel 16.

As illustrated, the bracket retention support 34 defines a u-shaped configuration 42. The base 44 of the u-shaped configuration defines the spaced-apart openings 36. Other orientations or shapes may be employed. Support braces 74 may extend from the vertically extending support 12.

As illustrated in FIG. 3A and sometimes with further reference to FIG. 3B, various additional accessory channels are illustrated. In addition to front-facing channel 16, accessory channel 20 (which is configured for engaging an electrical power source as will be described further herein), accessory channel 22 (illustrated as a lobe or shoulder configuration) that is configured for engaging slatboard 54, and accessory channel 24 (also illustrated as a lobe or shoulder or detent recess configuration). Additional, and duplicate channels are also illustrated.

As illustrated, panel 54 (slatboard) may have a shoulder adapter 50 that serves as an anchor that is configured for being received within channel 22 to engage the panel 54 to the channel 22. The shoulder adapter 50 could be integrated with the board 54 as an integrally formed component or it may be fastened to the board such as shown. Other configurations may be employed.

Figures 4A, 4B, 4C:
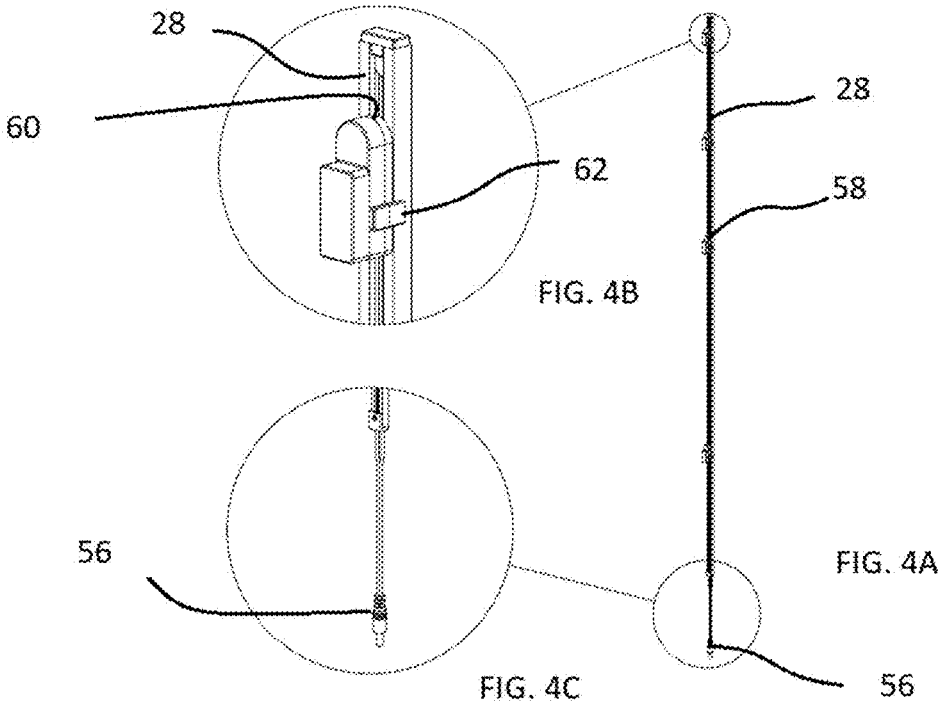
FIG. 4A illustrates a perspective, partial view of an electrical power source for use with the display stand assembly according to one or more embodiments disclosed herein.
FIG. 4B illustrates a perspective view of an electrical adaptor for use within the assembly illustrated in FIG. 4A according to one or more embodiments disclosed herein.
FIG. 4C illustrates a perspective view of an electrical power connection for use with the adaptor of FIG. 4B according to one or more embodiments disclosed herein.

With specific reference to FIGS. 4A, 4B, and 4C, an electrical power source 58 is provided having a track 28. The power source 58 is configured for engagement within the channel 20. Track 28 is configured for receiving a power connector 56, such as a pig-tail that will be described further herein. The power source 58 is configured such it can be engaged and disengaged with the channel 20 to thereby lock the power source 58 into place. In this manner, accessory devices using power can be electrically coupled to the leads in a same manner as power sources 58 to provide lighting or other characteristics to the display stand 10.

The power connector 56 is illustrated that includes a push-pull type connector, such as a pig-tail, for engageably receiving an external adaptor or source. Other types of connectors can be employed.

A plurality of power adaptors 60 are illustrated and configured for being slideably received along the track 28. Wings or other guiding members 62 may be provided along each of the adaptors 60. A connector 56, such as a pig-tail or similar, may extend from each of the adaptors 60 that can thus provide direct current to any accessory that is desired. In this manner, a lighting assembly, as an example, could be plugged into the first adaptor 60, and a subsequent lighting assembly could be plugged into subsequent adaptors 60. The adaptors 60 may have just enough of an interference fit in order for the adaptors 60 to be slideable about track 28, but also maintain position when placed in a desired location.

Figure 5:
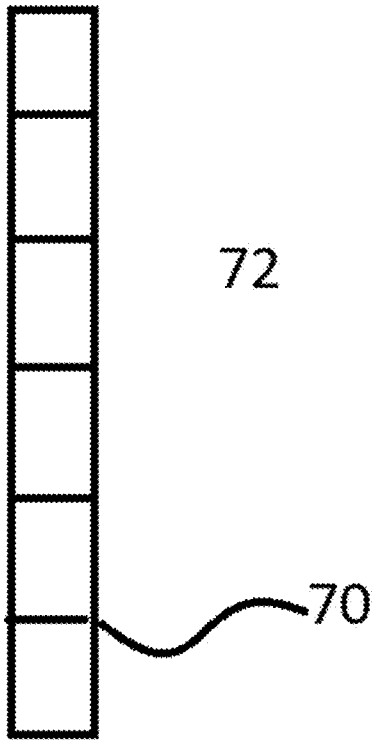
FIG. 5 illustrates an insert that includes one or more graduation lines for insertion into a channel of the display stand according to one or more embodiments disclosed herein.

As illustrated in FIG. 5, there is provided an insert 70 for being received within a channel of the plurality of channels such as channel 76. The insert 70 can define graduation lines 72 or other visual indicators for displaying position along the channel 76. In this manner, when a person is installing brackets 38, they can visualize positioning to make sure the brackets are vertically aligned, thus reducing the time required for installation, and increasing accuracy of the install.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A merchandise display stand comprising:

a vertically extending support configured for being positioned about a ground surface or against a vertical wall, wherein the vertically extending support defines a plurality of channels extending vertically along a length of the vertically extending support, the channels being configured for engaging one or more accessories;

a panel configured for extending from the vertically extending support and configured for serving as an origination point for retail accessories;

a first bracket retention support having a u-shaped configuration and configured for being positioned within a front-facing one of the plurality of channels that is partially defined by shoulder portions of the vertically extending support wherein a first surface of at least one of the shoulder portions is part of the periphery of the vertically extending support and a second surface opposite the first surface defines the front-facing one of the plurality of channels, the first bracket retention support having a base configured to abut the second surface of the shoulder portions when positioned within the front-facing one of the plurality of channels, the base defining spaced-apart openings for receiving portions of a bracket, the bracket configured for supporting at least a portion of a shelf or display; and a second bracket retention support having a u-shaped configuration and configured to replace the first bracket retention support within the front-facing one of the plurality of channels, the second bracket retention support having a base comprising a first side and second side, the base defining spaced-apart openings between the first side and second side, wherein the base of the second bracket retention support is a different thickness between the first side and second side from the base of the first bracket retention support.

2. The display stand according to claim 1, wherein one of the first bracket retention support and second bracket retention support is slideably received within the front-facing one of the plurality of channels.

3. The display stand according to claim 1, wherein the front-facing one of the plurality of channels defines a cut-out along a length between the shoulder portions thereof for providing access to the plurality of spaced-apart openings.

4. The display stand according to claim 1, wherein the panel defines a shoulder that is received within a side-facing one of the plurality of channels.

5. The display stand according to claim 1, wherein the panel is one of a peg board, slate board, solid board, or wire grid.

6. The display stand according to claim 1, further comprising an electrical power source that is configured for providing power to an accessory feature, the electrical power source having at least a portion disposed within one of the plurality of channels other than the front-facing one of the plurality of channels.

7. The display stand according to claim 6, wherein the electrical power source includes an I/O port that receives a cable that provides power.

8. The display stand according to claim 6, wherein the electrical power source includes a mounting flange that is configured for engagement within the same channel as the electrical power source.

9. The display stand according to claim 1, further including an insert for being received within a channel of the plurality of channels, the insert defining graduation lines or other visual indicators for displaying position along the channel.

10. The display stand according to claim 1, further including support braces extending from the support.

11. A merchandise display stand comprising:

a vertically extending support configured for being positioned about a ground surface or against a vertical wall, wherein the vertically extending support defines a plurality of channels extending vertically along a length of the vertically extending support, the channels being configured for engaging one or more accessories;

a panel configured for extending from the vertically extending support and configured for serving as an origination point for retail accessories; and a bracket retention support having a u-shaped configuration and configured for being positioned within a front-facing one of the plurality of channels that is partially defined by shoulder portions of the vertically extending support wherein a first surface of at least one of the shoulder portions is part of the periphery of the vertically extending support and a second surface opposite the first surface defines the front-facing one of the plurality of channels, the bracket retention support having a base configured to abut the second surface of the shoulder portions when positioned within the front-facing one of the plurality of channels, the base defining spaced-apart openings for receiving portions of a bracket, the bracket configured for supporting at least a portion of a shelf or display.

12. A merchandise display stand comprising:

a vertically extending support configured for being positioned about a ground surface or against a vertical wall, wherein the vertically extending support defines a plurality of channels extending vertically along a length of the vertically extending support, the channels being configured for engaging one or more accessories;

a panel configured for extending from the vertically extending support and configured for serving as an origination point for retail accessories;

a bracket retention support having a u-shaped configuration and configured for being positioned within a front-facing one of the plurality of channels that is partially defined by shoulder portions of the vertically extending support wherein a first surface of at least one of the shoulder portions is part of the periphery of the vertically extending support and a second surface opposite the first surface defines the front-facing one of the plurality of channels, the first bracket retention support having a base configured to abut the second surface of the shoulder portions when positioned within the front-facing one of the plurality of channels, the base defining spaced-apart openings for receiving portions of a bracket, the bracket configured for supporting at least a portion of a shelf or display; and an electrical power source that is configured for providing power to an accessory feature, the electrical power source having at least a portion disposed within one of the plurality of channels other than the front-facing one of the plurality of channels.

* * * * *